US005710641A

United States Patent [19]

Lowry et al.

[11] Patent Number: 5,710,641

[45] Date of Patent: Jan. 20, 1998

[54] METHOD AND SYSTEM FOR PRODUCT COMMUNICATION

[76] Inventors: William J. Lowry, 14245 U.S. Hwy. 24 (River Rd.), Grand Rapids, Ohio 43522; John Carcich, 671 Joette Dr., Gardnervile, Nev. 89410

[21] Appl. No.: 369,814

[22] Filed: Jan. 9, 1995

Related U.S. Application Data

[63] Continuation-in-part of Ser. No. 950,955, Sep. 25, 1992, Pat. No. 5,379,549.

[51] Int. Cl.[6] ..... H04N 1/40

[52] U.S. Cl. ..... 358/462; 358/471; 358/479

[58] Field of Search ..... 358/462, 468, 358/401, 450, 402, 400, 443, 448, 471; 382/317, 188, 186, 189, 190; 283/77; 47/41.01; 206/423, 232; 220/403; 229/921, 116.3, 117.22

[56] References Cited

U.S. PATENT DOCUMENTS

| | | | |
|---|---|---|---|
| 1,270,554 | 6/1918 | Rubel | 206/423 |
| 1,493,152 | 5/1924 | Gardner | 47/84 |
| 1,606,523 | 11/1926 | Gardner | 47/84 |
| 1,669,617 | 5/1928 | Kennedy | 47/84 |
| 2,774,187 | 12/1956 | Smithers | 47/41.12 |
| 2,814,910 | 12/1957 | Reparon | 47/84 |
| 3,021,046 | 2/1962 | Pullen | 47/84 |
| 3,127,011 | 3/1964 | Weddle | 206/423 |
| 3,342,329 | 9/1967 | Knight | 206/423 |
| 3,552,059 | 1/1971 | Moore | 47/41.12 |
| 3,973,356 | 8/1976 | Schacht | 47/41.01 |
| 4,071,064 | 1/1978 | Saul | 220/324 |
| 4,075,786 | 2/1978 | van Zyl | 47/84 |
| 4,170,301 | 10/1979 | Jones | 206/423 |
| 4,330,059 | 5/1982 | Freeman | 206/423 |
| 4,659,876 | 4/1987 | Sullivan | 379/96 |
| 4,662,107 | 5/1987 | Van Den Kieboom | 47/84 |
| 4,849,809 | 7/1989 | Tahara | 358/540 |
| 4,936,046 | 6/1990 | Miller | 47/41.01 |
| 4,941,572 | 7/1990 | Harris | 206/42.3 |
| 5,003,405 | 3/1991 | Wulforst | 358/402 |
| 5,038,930 | 8/1991 | Holtkamy | 206/232 |
| 5,115,915 | 5/1992 | Harris | 206/524 |
| 5,340,966 | 8/1994 | Morimoto | 235/376 |
| 5,452,379 | 9/1995 | Poor | 382/317 |

FOREIGN PATENT DOCUMENTS

| | | | |
|---|---|---|---|
| 4028276 | 3/1992 | Germany | 229/921 |
| 8203460 | 9/1982 | Netherlands . | |
| 231167 | 5/1944 | Switzerland . | |

*Primary Examiner*—Thomas D. Lee
*Assistant Examiner*—Jerome Grant, II

[57] ABSTRACT

A system for communicating between a plurality of human individuals communicates first information from a first individual to a second individual through a telephone line to thereby direct that a product be produced at a remote location. Second information is written in a personal stylized script onto an information receiving medium to produce a first note page. The first note page is then digitized and transferred from a first location to a second location. The digitally formatted first note page is then received and reformulated at a second location. An exterior box is located at the second location and has upper, lower, front, back and sidewall panels forming a rectangular shaped box having an open front. An open top vase is received and fastened within the box. A receiving frame on the box then receives the second note page for shipment to a final destination.

14 Claims, 3 Drawing Sheets

METHOD AND SYSTEM FOR PRODUCT COMMUNICATION

This is a continuation-in-part of U.S. application Ser. No. 07/950,955 filed Sep. 25, 1992, now U.S. Pat. No. 5,379,549.

FIELD OF THE INVENTION

The present invention pertains to a receptacle for shipping horticultural products such as a floral arrangement. The present invention also pertains to a method and system for product communication. More particularly, the present invention pertains to a method and system for communicating a personal note and/or photograph along with a product which is to be delivered at a remote location.

BACKGROUND OF THE INVENTION

In the shipment of floral arrangements, it has been necessary to provide adequate protection from abrasion and to provide the correct amount of moisture. Conventional receptacles have provided for these purposes but still possess certain disadvantages. Conventional receptacles do not provide for a shipping receptacle that is simple and inexpensive to manufacture while maximizing use of the area within the receptacle.

One such receptacle is U.S. Pat. No. 4,936,046, to Miller. Miller discloses a receptacle for the transport, storage and display of horticultural articles and shows a base, inner receptacle, insert element, side element, and cover element. The elements are slidably connected to form the receptacle without any connecting measures. This conventional art requires a plurality of pieces that require separation every time the vase containing the flowers is to be assembled or removed. Accordingly, a number of improvements to the art may be found in manufacture and assembly of the horticulture receptacle.

Modern product delivery and communication such as the delivery of a bouquet of flowers with a personal note has undergone a dramatic change within the last fifty years. Modern citizens expect delivery of products within the same day and over great distances. However, along with the increased speed of modern delivery, the human element of communication has seemingly become lost or forgotten.

By way of example, the modern consumer may request that a bouquet of flowers be delivered to a friend in another part of the country by placing an order with a national network of florists. The modern consumer would generally call a "1-800" number or simply telephone a local florist that is part of a national network. After the consumer places the order, communication is delivered through the network to a florist in the locality of delivery. The local florist then prepares a bouquet of flowers from existing stock, types or hand writes a message to be delivered with the floral arrangement, then delivers the ensemble. This form of communication does not provide for a personal note in the handwriting of the consumer nor does it provide a visual indication of origin such as a photographic picture. Accordingly, a number of improvements may be made to the art which will provide a more personal element to human communication.

SUMMARY OF THE INVENTION

The present invention relates to a receptacle for storage and transport of a floral arrangement and other horticultural products under rough conditions, for hours of duration, and without damage to the interior products. Manufacture and assembly of the receptacle via the present invention provides a reduction in the amount of labor required and provides economic benefits as well.

The receptacle includes an exterior box having upper, lower, back and sidewall panels forming a rectangular shaped box having an open front; an open top vase including a moisture retention block disposed within the lower portion of the vase and encompassed by a moisture barrier for maintaining the proper humidity for the floral arrangement which includes an open end closed by a retaining means for holding the vase in a stable condition during shipping; at least one front panel; and means for securing said at least one front panel to the exterior box.

In one aspect of this invention, the horticultural products are an arrangement of fresh flowers having cut stems, and the moisture retention block is a foam block or other type of moisture retention block adapted to receive the stems of the flowers therein.

The present invention also relates to the personal communication of a product to a recipient at a remote location. A transmitting party first communicates his intention of delivering a product to a third party which is responsible for actual product delivery. The product, such as a bouquet of flowers, is then assembled by the third party at a location which is remote from the geographical area of the transmitting party. The transmitting party then inscribes a personal note for eventual receipt by the intended recipient. The personal note is digitally encoded and then transmitted to the third party for incorporation into the product. Upon receipt of the digital information by the third party, the message is decoded and incorporated into the product. In the case of the flower bouquet, the note may be affixed to a part of the receptacle which is used to transport the bouquet. The product is then delivered to the intended recipient.

In an alternate embodiment, the personal note may take the form of a photographic image or photographic representation of the transmitting party. In this embodiment, the photograph is digitally encoded and transmitted to the third party. The photograph is then decoded and incorporated into the product. The photographic image, just as the personal note, may be affixed to a part of the receptacle which is used to transport the product. The product is then delivered. A photographic image may also be digitally encoded and transmitted along with the fax note to provide enhanced personal communication.

A system for communicating between a plurality of human individuals includes means for communicating a first information from a first individual to a second individual through a conventional telephone line to thereby direct that a product be produced at a remote location. A pencil and paper or touch sensitive screen is used to write a second information in a personal stylized script onto an information receiving medium thereby producing a first note page. A facsimile machine, computer, or similar devices then digitizes the first note page into a digital format. The facsimile machine then transfers the first note page as a digital format from a first location to a second location where it is received by a similarly equipped machine. The facsimile machine then reformulates the digital first note page as a second note page at the second location. A frame or adhesive is then used to attach the second note page to the product. The first note page, and therefore the second note page, may optionally incorporate a photographic picture.

This system may be used with a product receptacle such as an exterior box having upper, lower, back and sidewall panels forming a rectangular shaped box, said upper and lower panels being closable and thereby providing said exterior box with a closable top and bottom. The product receptacle also includes a receiving frame disposed on the front of the product receptacle to receive the second note page. The system may utilize a computer to digitally combine the second information in the form of a written note with a third information in the form of a picture before transmission to the third party.

The method of communication will include first acquiring a first product description information from an individual at a first location, ordering a product at a second location based upon the first product description, then acquiring a first personal information from the individual at the first location. Next, the first personal information will be transmitted from the first location to the second location, thereby receiving the first personal information at the second location. After the first personal information is expressed in a tangible medium at the second location, the tangible medium will be affixed to the product.

The foregoing method may be included with the acquiring of a second personal information in the form of a photograph from the individual at the first location, and then transmitting the second personal information from the first location to the second location. Upon receipt at the second location, the second personal information will be expressed in a tangible medium through a printing device. The second personal information may then be combined with the first personal information in the tangible medium.

One object of the present invention is to provide a novel receptacle that overcomes the disadvantages of the conventional art, is simple and inexpensive to manufacture, and extremely effective for delivering flowers or other horticultural products.

Another object of this invention is to provide a moisture barrier encompassing the moisture retention block and extending up and over the floral arrangement. The moisture barrier is sealed at the open end by a tie string or the like and includes a plurality of holes located in proximity of the sealed end for allowing the proper humidity to be maintained.

It is another object of this invention to provide for the vase is held in a stable position during shipping that employs a simple and inexpensive means to accomplish such. The vase is held by employing an interior liner or using a plurality of cleats.

It is still another object of this invention to provide at least one product box for storing the gift requested by a customer. The invention provides for at least one product box to be located in proximity to the upper panel of the exterior box.

It is an object of this invention to provide an exterior box made of corrugated design having the flutes running in one direction and the means for holding the vase in a stable condition during shipping also of a corrugated design but with the flutes running at a perpendicular angle to the exterior box.

It is still another object of this invention to allow a transmitting party of a product, such as a floral arrangement, to hand write a short message and then have the handwritten message or other type of message transmitted by facsimile or an equivalent mode of transmission to the person assembling the floral arrangement. The transmitted message is then communicated along with the floral arrangement to the recipient.

It is also an object of this invention to provide a method and system for product communication over very large distances in a relatively short period of time. It is a further object to provide handwritten communication and photographic communication along with a delivered product to an intended recipient.

These and other objects and advantages will become apparent from the following description of a preferred embodiment of the invention taken together with the accompanying drawings.

BRIEF DESCRIPTION OF THE DRAWINGS

The invention may take form in various arrangements. The drawings are only for purposes of illustrating a preferred embodiment and are not to be construed as limiting the invention.

DESCRIPTION OF THE PREFERRED EMBODIMENTS

Figure 1:
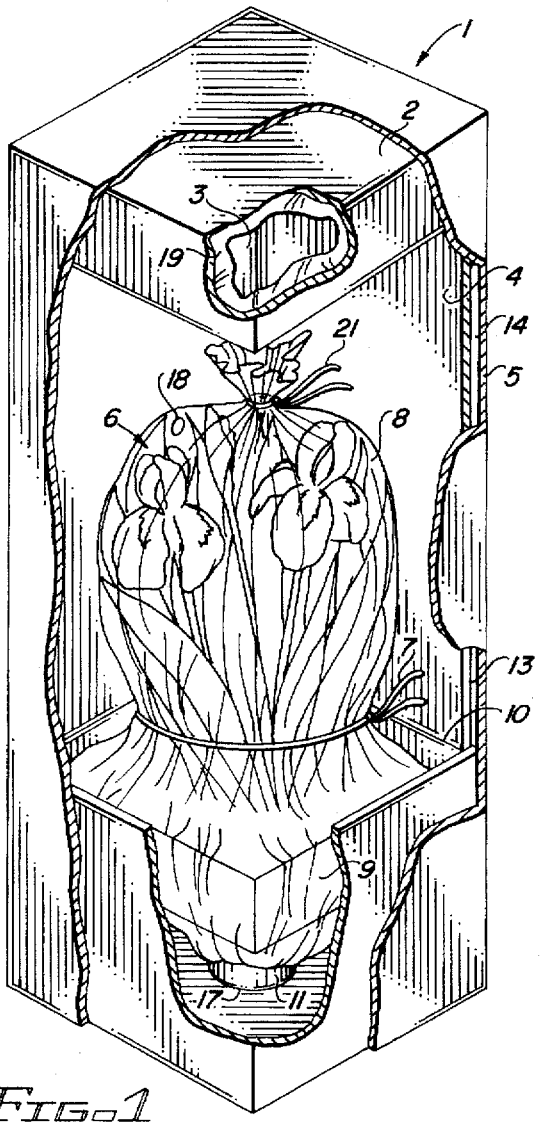
FIG. 1 is a perspective view of the shipping receptacle for a floral arrangement or other horticultural products of the present invention.

FIG. 1 illustrates receptacle 1 for shipping horticultural products according to the preferred embodiment of this invention. The receptacle 1 is designed for storage, transport and everything display of a floral arrangement. The receptacle 1 is constructed from a corrugated type design and includes exterior receptacle 5, air space 14, open top vase 10, interior liner 4 and product box 2. Receptacle 1 may be opened at the top to retrieve floral arrangement 6.

The exterior receptacle 5 includes upper, lower, back and sidewall panels forming a rectangular shaped box having an open front. Exterior receptacle 5 according to the preferred embodiment is a box. The exterior receptacle 5 provides protection to the horticulture product from abrasions and the elements such as heat, cold and rain. An air space 14 is disposed within the inside walls of exterior receptacle 5 and also acts as an insulator for protecting the floral arrangement or other horticultural products from heat and/or cold during shipping.

The open top vase 10 fits slidably into a bottom of the receptacle and is preferably made from a non-moisture resistant material such as board stock or fiberboard stock. Although a material such as ceramic glass may be used, such materials are relatively expensive and are easily susceptible to damage. A material such as board stock is not easily cracked and is very cost effective. It should be noted that moisture barrier 8 prevents water damage to vase 10 from moisture retention block 9 through placement therebetween. The vase could include high quality graphics on its exterior to give a pleasing appearance.

The open top vase 10 houses a moisture retention block 9 made of oasis, foam, moss or the like and has an end adapted for receiving the floral arrangement or other horticultural products therein. In the embodiment of FIG. 1, moisture barrier 8 encompasses the moisture retention block 9 and extends upward to fully encompass floral arrangement 6. The moisture barrier 8 is preferably a plastic bag. However, moisture barrier 8 could be metallic foil, impregnated craft paper or an equivalent film. It is preferable that the end of the moisture barrier 8 be closed with an upper retaining means 21 which may be a tie string as well as a type of seal such as ultrasonic, heat heal or glue.

A lower retaining means 7 is used in the preferred embodiment to hold floral arrangement 6 and moisture retention block 9 in place. The members of the floral arrangement are tied together to provide mutual support. Additionally, lower retaining means is used to shape the moisture barrier 8 to the floral arrangement. Lower retaining means 7 is preferably made of string but may also be a strip of adhesive.

The moisture barrier 8 may include a hole or holes represented by hole 18 located in proximity to the open end of the moister barrier 8 for controlling the humidity within the floral arrangement 6. Moisture barrier 8 is also used to protect a non-moisture resistant vase from moisture emitted from moisture retention block 9. It should be understood that the number and size of any holes are optimized for general use or may be specifically tailored for rare and exotic plants. Additionally, the moisture barrier 8 may be made of a gas permeable membrane which would allow vaporized water (measured as humidity) to diffuse therethrough. In this case, no solid or liquid permeable holes would be present. Moreover, some rare and tropical foliage may require a moisture barrier 8 which has no holes, thus providing a humid environment. Moisture barrier 8, through helping to retain moisture, provides protection to the horticulture product from elemental extremities.

Moisture barrier 8 surrounds moisture retention block 9. The moisture barrier 8 is secured to the open top vase 10 by an adhesive 11 at adhesive point 17. The adhesive 11 can be glue, temperature reactive adhesive, pressure reactive adhesive, double sided tape, a staple or another type of securing means. The moisture retention block 9 is made of foam. However, it could be made out of other materials such as oasis, Sahara foam, moss or other suitable material. Although not shown, moisture retention block 9 may be glued to moisture barrier 8 to provide additional support during transport.

The interior liner 4 is used to wrap the floral arrangement 6. The interior liner 4 is preferably made using one piece of board stock having three folds. The interior liner 4 helps to form the air space 14 and also provides elemental protection. Moisture within the receptacle 1 which is exterior to the moisture barrier 8 is trapped by interior liner 4.

Figure 2:
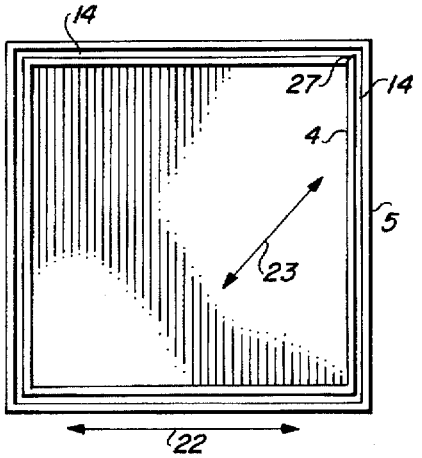
FIG. 2 is a partial sectional view showing the interfitting relationship of the receptacle of FIG. 1.

The two ends of interior liner 4 are joined together at wall joint 27 as shown in FIG. 2. Referring back to FIG. 1, interior liner 4 wraps floral arrangement 6 before the open top vase 10 is inserted into receptacle 1. Thus, the floral arrangement 6 is inserted into the exterior receptacle 5 with the interior liner 4 protecting the floral arrangement 6. The exterior of receptacle 5 can contain high quality graphics to give a pleasant appearance. The interior liner 4 is also used to retain the open top vase 10 in position. A bottom edge of interior liner 4 contacts a top edge of open top vase 10 at contact point 13. This prevents the open top vase 10 from sliding within receptacle 1.

As shown in the embodiment of FIG. 1, receptacle 1 includes a product box 2 in the upper panel of the exterior box 5 for shipping a gift 3 along with the floral arrangement 6. It should be noted that the invention as described may be used without the product box 2. The product box 2, when used, is securely held to exterior receptacle 5 by support from interior liner 4 and the exterior receptacle itself. The gift 3 may be a box of candy, a bottle of wine or any other suitable gift. The gift 3 is wrapped by a film barrier 19 which is made out of plastic. However, this barrier could also be made from metallic film or the like before being placed around the product box 2. This helps to protect the gift 3 from deterioration from the humidity required by the floral arrangement. A second product box could additionally be inserted on top of product box 2 by shortening the length of interior liner 4.

Turning to FIG. 2, it will be seen that the exterior box 5 is made of corrugated or an equivalent design having flutes running in one direction as illustrated at 22. The interior liner 4 is also of a fluted type construction where the perpendicular flutes run at perpendicular angles to the exterior receptacle 5 as illustrated at 23. By allowing for the box construction of the receptacle 1 to have corrugates running in different directions, optimum strength can be maintained in all directions and thus provide a receptacle 1 that is difficult to collapse. Wall joint 27 joins two surfaces on different ends of interior liner 4.

Figure 3:
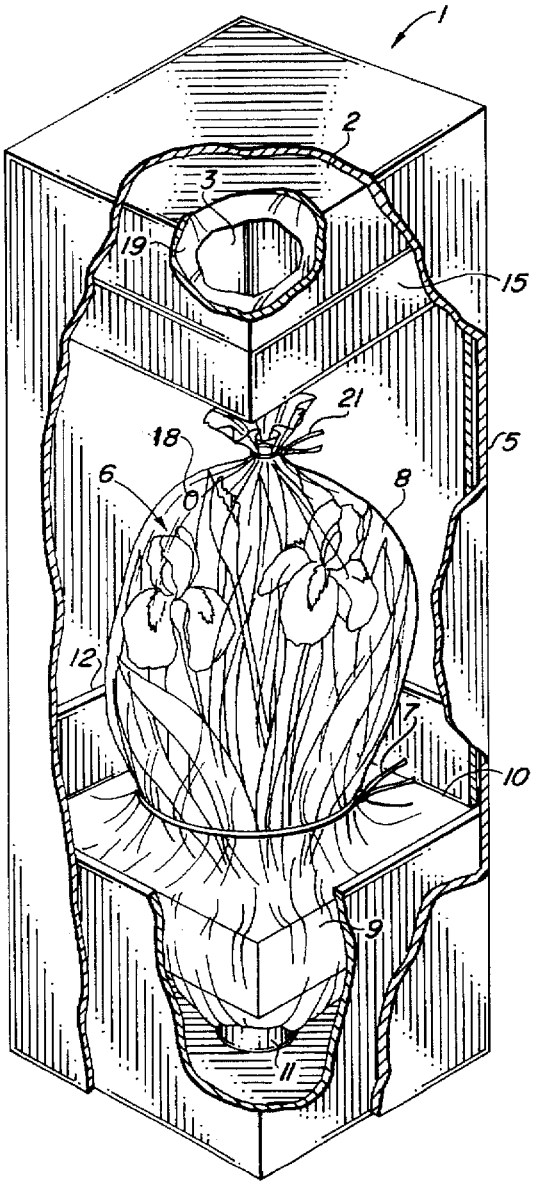
FIG. 3 is an alternate embodiment of the shipping receptacle showing the use of cleats to hold the vase and product box in place.

FIG. 3 illustrates an alternate embodiment of the invention in which cleats 12 are employed for preventing the open top vase 10 from sliding within the exterior box 5. The cleats 12 are glued, stapled, or otherwise fastened to the interior wall of the exterior box 5 and are used in pairs opposite one another. It is preferable that the pairs of cleats 12 are made of the same material as the exterior box 5 but other materials may be used. Additional cleats 15 are employed in like manner to secure the product box 2. It is to be realized that another pair of cleats may be employed to secure an additional product box within an open area within the exterior box 5. Although not necessary for the present invention, the additional cleats 15 may be used to secure a separator piece of board stock to separate the product box 2 from floral arrangement 6.

Figure 4:
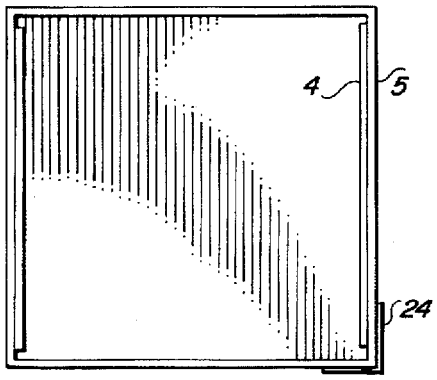
FIG. 4 illustrates a perspective view of sealing the exterior box.
Figure 5:
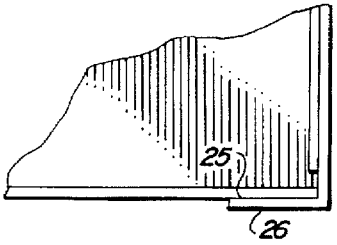
FIG. 5 illustrates an alternate embodiment for sealing the exterior box.

FIG. 4 is a view illustrating the exterior box 5 being sealed with a piece of tape 24 and FIG. 5 illustrates the exterior box 5 being sealed with glue joint 25 including a flap 26.

Figure 6:
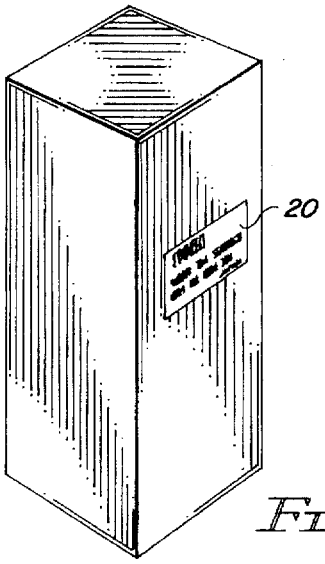
FIG. 6 is a perspective view showing a hand written note sent by facsimile to the person assembling the receptacle for inclusion with the floral arrangement.

FIG. 6 illustrates a facsimile of a handwritten note 20 which is included with the floral arrangement and gift before shipping the receptacle 1 to the recipient. The handwritten note is transmitted by U.S. mail, facsimile or an equivalent mode of transmission to the person assembling the floral arrangement and mailed with the floral arrangement to the recipient. This allows a customer to purchase flowers and a gift but send a handwritten personalized note with the order from another state many miles away from where the order is to be delivered.

Figure 7:
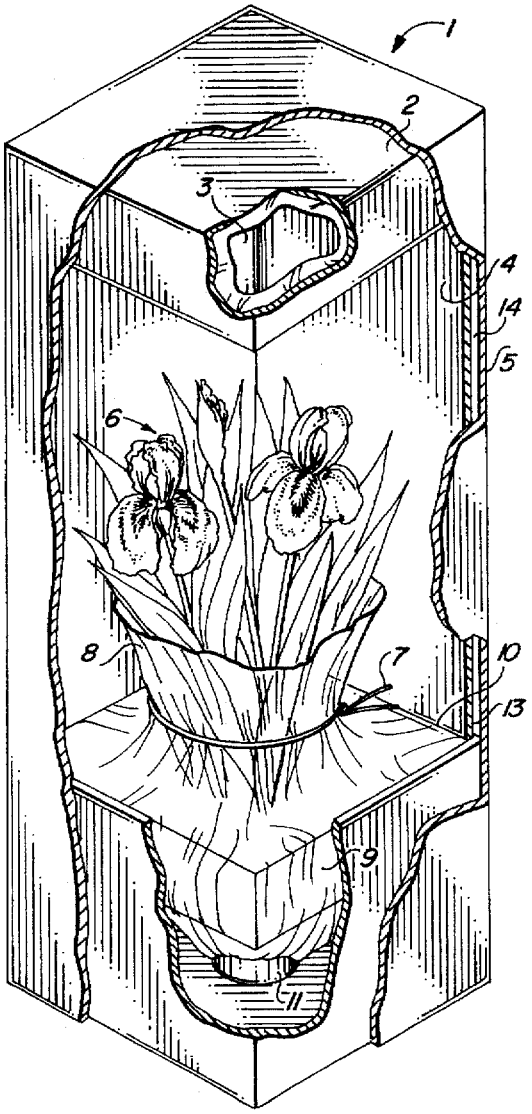
FIG. 7 is a perspective view of the shipping receptacle showing the moisture barrier extending an insubstantial degree above the rim of the vase.

FIG. 7 illustrates the shipping receptacle constructed with moisture barrier 8 extending partially over floral arrangement 6. In this embodiment, the moisture barrier is still used to protect a non-moisture resistant vase such as vase 10. This embodiment is preferable for horticulture products which do not require extensive humidity retention during transport.

Figure 8:
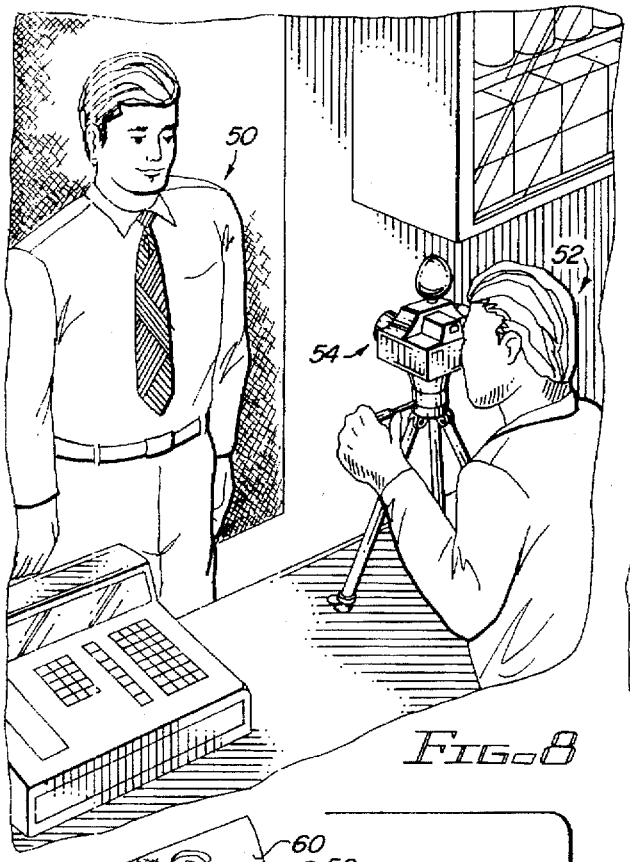
FIG. 8 is a perspective view of a transmitting party being photographed.

FIG. 8 illustrates a transmitting party 50 being photographed by a photographer 52 with a camera 54. Camera 54 may be a conventional camera which transfers an image onto photographic film. In this case, the photograph must be digitally encrypted before transmission. A digital scanner and computer for encrypting photographs is known in the art. In an alternative embodiment, camera 54 may be a digital camera which "records" the image in a digital format from within the camera. In this case, the image is ready for transmission to a distant location.

Figure 9:
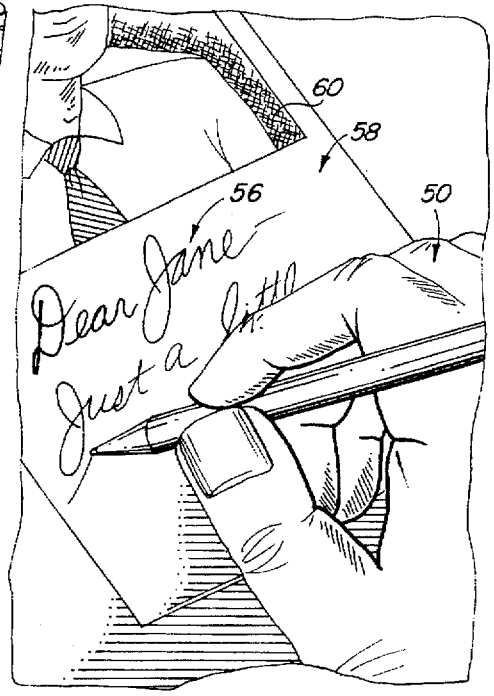
FIG. 9 is a perspective view of a hand written note by a transmitting party.

FIG. 9 illustrates a transmitting party writing a personal note 56 onto a personal note page 58. As shown, photograph 60 is formed integrally with the note page 58. This may be accomplished by utilizing a larger "border" around the picture towards the bottom side. The foregoing is by way of example only. The present invention contemplates that either the photographic picture 60 or note 56 may be digitally transmitted to a remote location independent from the other. As an alternate embodiment, the entire system may be digital such that the transmitting party 50 would write the note on a touch sensitive screen for direct digital encoding. In this case, the digitally encoded message could be combined with a digitized picture for transmission to the third party.

Figure 10:
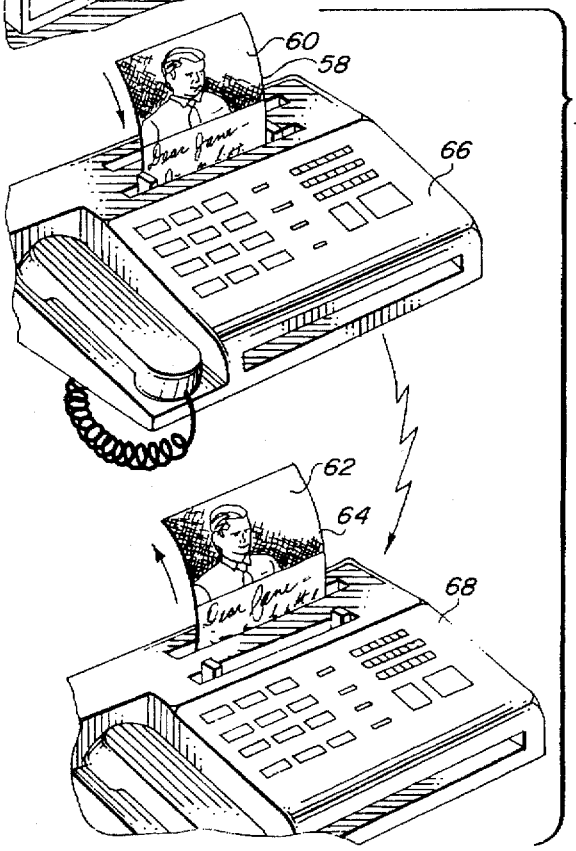
FIG. 10 is a schematic representation of digital encryption and transmission of a personal photograph and note to an intended recipient at a remote location.

FIG. 10 schematically represents the digital transmission of a picture 60 and note 56 to a third party. As shown, the note page 58 incorporating photograph 60 is inserted into digital facsimile machine 66 at a transmitting location. The note page 58 is digitally encoded by facsimile machine 66 and transmitted to a receiving facsimile machine 68. After the digital image is decoded, a second note page 64, including a second photograph 62 is outputted therefrom.

Figure 11:
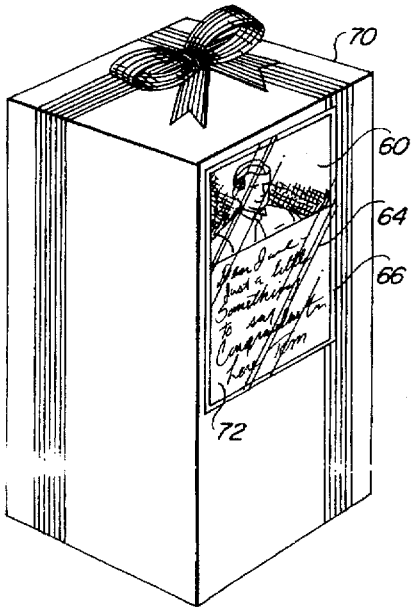
FIG. 11 is a perspective view of a product incorporating a personal note and photograph for delivery at a remote location.

FIG. 11 is a representation of a product receptacle 70 which is ready for immediate delivery to an intended recipient. Second note page 64 incorporating second photograph 60 is shown attached thereon. In the shown embodiment, a frame 66 is used to receive second note page 64. Frame 66 is made from cardboard and is permanently glued onto the exterior of product receptacle 70. A transparent cover 72 is permanently affixed to frame 66 and provides protection during transportation of product receptacle 70. Transparent cover 72 is preferably a flexible sheet of plastic but may alternatively be a sheet of hard plastic or glass. Frame 66 may also be of plastic or glass construction. In an alternative embodiment, frame 66 does not incorporate a transparent cover, but merely provides a supporting means for the second note page 64.

Transparent note page 64 may be affixed to the exterior of product receptacle 70 with a suitable adhesive or with double sided tape. In yet another embodiment, it is anticipated that the product receptacle will incorporate a transparent side so that the interior product may be viewed during shipment. In this embodiment, a transparent sleeve is incorporated internal to the product receptacle 70 such that second note page 64 may be incorporated therein.

It is anticipated that a computer may alternatively be used to create and/or send a portion or all of the photograph 60 and note page 58. In this case, a computer at a receiving station may be employed to receive the digital information and transform same into a tangible representation.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

We claim:

1. A system for communicating between a plurality of human individuals comprising:

means for communicating a first information from a first individual to a second individual through a telephone line to thereby direct that a product be produced at a remote location;

means for writing a second information in a personal stylized script onto an information receiving medium thereby producing a first note page;

means for digitizing the first note page into a digital format;

means for digitally combining the second information in the first note page with third information wherein the digitally combined second and third information forms the first note page;

means for transferring the digitally formatted first note page from a first location to a second location;

means for receiving the digitally formatted first note page at the second location;

means for reformulating the digitally formatted first note page as a second note page at the second location;

an exterior box having upper, lower, front, back and sidewall panels forming a rectangular shaped box, wherein said exterior box has an open front;

an open top vase slidably received within said open front of said exterior box;

a fastening member for holding said vase in a stable condition inside said exterior box during shipment; and a receiving frame disposed on the front of said exterior box to receive the second note page.

2. The system according to claim 1 wherein the first note page incorporates a photographic picture.

3. The system according to claim 1 wherein the information receiving medium is a touch sensitive screen for direct digital encoding of the second information.

4. The system according to claim 3 wherein said third information is a photographic picture.

5. The system according to claim 1 further comprising:

means for acquiring a first product description information from the first individual at a first location; and means for ordering a product at a second location from the second individual based upon the first product description.

6. The method according to claim 5 further comprising:

means for affixing the second note page within the receiving frame.

7. A method of communication of a first information from a first individual to a second individual through a conventional telephone line for use with a means for writing a second information in a personal stylized script onto an information receiving medium to produce a first note page, means for digitizing the first note page into a digital format, means for digitally combining the second information in the first note page with third information wherein the digitally combined second and third information forms the first note page, means for transferring the first note page from a first location to a second location, means for receiving the first note page, means for reformulating the digital first note page as a second note page, means for attaching the second note page to a product comprising the steps of:

acquiring a first product description information from an individual at a first location;

ordering a product at a second location based upon the first product description;

acquiring a first personal information from the individual at the first location;

acquiring a second personal information from the individual at the first location;

digitally combining the first personal information with the second personal information;

transmitting the combined first and second personal information from the first location to the second location;

receiving the combined first and second personal information at the second location;

expressing the combined first and second personal information in a tangible medium at the second location; and affixing the tangible medium to the product at the second location.

8. A system for communicating between a plurality of human individuals to personalize a product receptacle for delivery comprising:

a first note page for receiving a first information from a first individual at a first location and directing that a product be produced at a second location remote from said first location, and for indicating delivery to a second individual;

a first facsimile machine for digitizing the first note page into a first digital note page and for digitizing photographic information from the first individual and combining the digitized photographic information into the first digital note page;

a first communication line connected to the first facsimile machine for transferring the first digital note page from a first location to the second location;

a second facsimile machine connected to the first communication line for receiving the first digital note page at the second location and reformulating the first digital note page as a second note page; and a product receptacle including a message frame adapted for receiving the second note page therein such that a personalized product receptacle may be delivered to said second individual.

9. The system for communicating between a plurality of human individuals according to claim 8, further comprising an interior liner for holding said vase.

10. The system for communicating between a plurality of human individuals according to claim 8, wherein the product receptacle comprises:

an exterior box having an upper, lower, back and sidewall panels forming a rectangular shaped box having an open front, wherein said upper and lower panels are closable thereby providing said exterior box with a closable top and bottom;

a product box located in proximity to said upper panel of said exterior box for storing a gift requested by a customer;

at least one front panel for closing said exterior box; and means for securing said at least one front panel to said open front of said exterior box.

11. The system for communicating between a plurality of human individuals according to claim 8, wherein the product receptacle comprises:

an exterior box having an upper, lower, back and sidewall panels forming a rectangular shaped box having an open front, wherein said upper and lower panels are closable thereby providing said exterior box with a closable top and bottom;

an open top vase for holding horticultural products slidably received within said open front of said exterior box;

a retaining member for holding said vase in a stable condition inside said exterior box during shipment;

at least one front panel for closing said exterior box; and means for securing said at least one front panel to said open front of said exterior box.

12. The system for communicating between a plurality of human individuals according to claim 8, wherein the product receptacle is a product receptacle for horticulture products, said product receptacle comprising:

an exterior box having an upper, lower, back and sidewall panels forming a rectangular shaped box having an open front, wherein said upper and lower panels are closable thereby providing said exterior box with a closable top and bottom;

an open top vase for holding the horticultural products slidably received within said open front of said exterior box;

a retaining member for holding said vase in a stable condition inside said exterior box during shipment;

a product box located in proximity to said upper panel of said exterior box for storing a gift requested by a customer;

at least one front panel for closing said exterior box; and means for securing said at least one front panel to said open front of said exterior box.

13. The system for communicating between a plurality of human individuals according to claim 12, further comprising a moisture barrier which includes:

retaining means for closing an open end of said moister barrier; and a plurality of holes located in proximity to a top of said moisture barrier for maintaining humidity of said horticultural products.

14. The system for communicating between a plurality of human individuals according to claim 13, further comprising a plurality of pairs of cleats for holding said vase.

* * * * *

UNITED STATES PATENT AND TRADEMARK OFFICE

CERTIFICATE OF CORRECTION

PATENT NO. : 5,710,641

DATED : January 20, 1998

INVENTOR(S) : Lowry et al.

It is certified that error appears in the above-identified patent and that said Letters Patent is hereby corrected as shown below:

In col. 8, ln. 51, change "method" to --system--.

Signed and Sealed this

Eighth Day of September, 1998

*Attest:*

Bruce Lehman

BRUCE LEHMAN

*Attesting Officer*

*Commissioner of Patents and Trademarks*